US006005308A

United States Patent [19]

Bryde et al.

[11] Patent Number: 6,005,308

[45] Date of Patent: Dec. 21, 1999

[54] ELECTRICAL SWITCH AND DIMMER CONTROL DEVICE

[75] Inventors: Gary William Bryde, Catasauqua; James Edgar Swain, Bethlehem; John Roderick Woodman, Coopersburg; Mark Andrew Cieri, Allentown, all of Pa.

[73] Assignee: Lutron Electronics Co., Inc., Coopersburg, Pa.

[21] Appl. No.: 08/040,423

[22] Filed: Mar. 31, 1993

Related U.S. Application Data

[63] Continuation-in-part of application No. 07/860,922, Mar. 31, 1993, Pat. No. 5,207,317.

[51] Int. Cl.[6] ..... H01H 9/06

[52] U.S. Cl. ..... 307/157; 307/139; 200/335; 200/339; 323/905

[58] Field of Search ..... 200/335, 339, 200/452, 454, 457, 458; 307/140, 141, 115, 157, 125, 139; 323/905

[56] References Cited

U.S. PATENT DOCUMENTS

| | | | |
|---|---|---|---|
| 4,221,941 | 9/1980 | Genovese | 200/67 |
| 4,429,200 | 1/1984 | Glenn et al. | 200/153 |
| 4,939,383 | 7/1990 | Tucker et al. | 307/139 |
| 4,947,054 | 8/1990 | Flowers et al. | 307/125 |
| 5,189,259 | 2/1993 | Carson et al. | 174/66 |
| 5,213,204 | 5/1993 | Sommer | 200/303 |
| 5,262,678 | 11/1993 | Flowers et al. | 307/125 |
| 5,412,169 | 5/1995 | Comerci et al. | 200/339 |
| 5,601,183 | 2/1997 | Boyd | 200/553 |

OTHER PUBLICATIONS

Home Automation Limited Brochure Slidedimmer mode # SC630W1D; Jan. 1984.

*Primary Examiner*—Albert W. Paladini
*Attorney, Agent, or Firm*—Seidel, Gonda, Lavorgna & Monaco, PC

[57] ABSTRACT

An electrical switch and dimmer device for controlling current applied to a load comprises a bezel assembly (16) which includes a bezel housing (17), a switch actuator (18) and a dimmer actuator (19). The bezel housing supports both switch and dimmer actuators for respective movement between first and second positions, whereby the on/off state of an electrical switch adapted to apply power to an electrical load (e.g. an electric light or fan) is controllable, as is the level of power applied to the load by the switch. The bezel housing and the switch/dimmer actuators which it supports comprise a self-contained assembly which can be releasably connected to a yoke member (20) on which an electrical switch and dimmer circuitry are mounted. Preferably, the switch actuator comprises a paddle-type actuator (18) which is pivotally mounted between a pair of opposing side walls (48A, 48B) of the bezel housing, and the dimmer actuator comprises a slidably mounted member (21) which is guided by a rectilinear slot (23) formed in one of the bezel walls adjacent an edge of the paddle actuator.

17 Claims, 4 Drawing Sheets

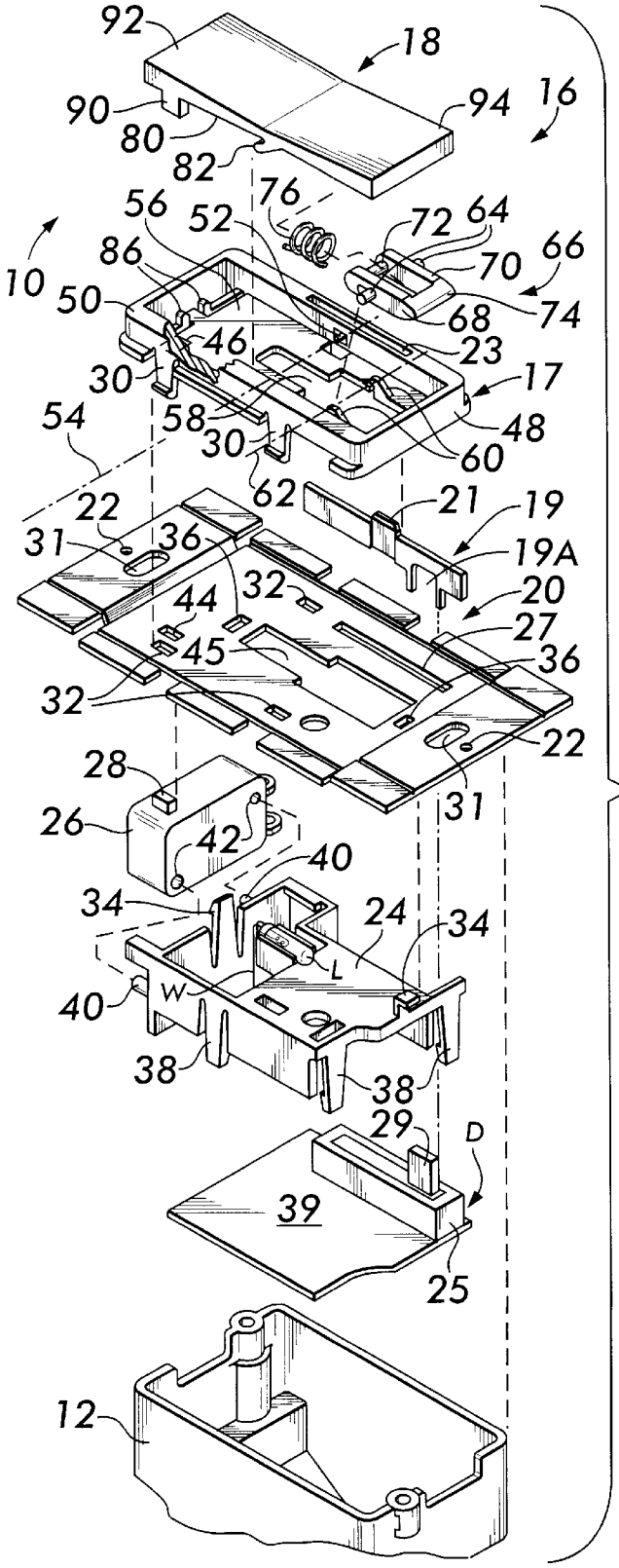
FIG. 2
FIG. 7
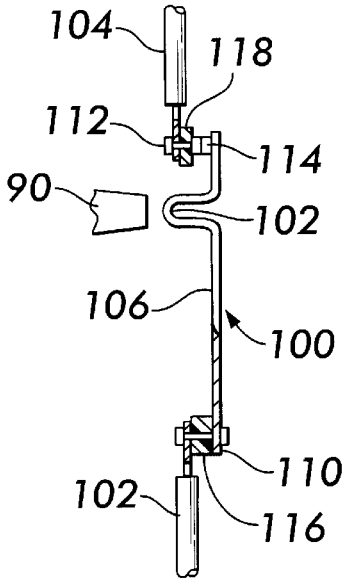
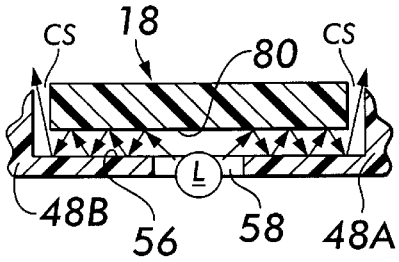
FIG. 8

ELECTRICAL SWITCH AND DIMMER CONTROL DEVICE

CROSS-REFERENCE TO RELATED APPLICATIONS

This application is a continuation-in-part of U.S. application Ser. No. 07/860,922, filed on Mar. 31, 1993, Now U.S. Pat. No. 5,207,317, in the names of W. Bryde, James E. Swain III, and John R. Woodman and entitled "SNAP ACTION SWITCH ACTUATOR."

BACKGROUND OF THE INVENTION

1. Field of the Invention

The present invention relates to improvements in switch-actuating and dimmer control devices for controlling electrical power applied to a load, in particular, a load which is adapted to operate at different power levels, such as electrical lamps, fans, etc.

2. Background of the Invention

A wide variety of switch actuators are commercially available for controlling the switching of power between a power source and an electrical load. Many of these actuators either incorporate or are otherwise combined with a device for varying the level of power applied to the load, hereinafter referred to as a "dimming" device or "dimmer." To enhance the appearance of the switch and dimmer actuators (which are often independent members), especially those intended for use in the home, it is known to surround or "frame" the actuators with a rectangular bezel. The bezel housing is usually attached to a "yoke" or "strap" which, in addition to functioning as the means by which the switch/dimmer is connected to a conventional wall box, sometimes serves as a platform for supporting the switch and/or dimmer components.

One device of the above type is the Decora Touch Dimmer made and sold by Leviton Manufacturing Co., Little Neck, N.Y. Such a device comprises a relatively large, rectangularly shaped switch/dimmer actuator which is supported and surrounded by a rectangular bezel. The bezel, which is made of plastic, is releasably connected to a yoke by a plurality of resilient tabs which engage apertures in the yoke plate. The switch/dimmer is of the "capacitance" type, comprising solid state touch-sensitive circuitry for controlling the light level. The switch/dimmer actuator is made of metal and is immovably positioned within the bezel frame. One touch of the actuator by the user's finger causes the switch to turn on or off, depending on its original state. Touching and holding the actuator acts to vary the power level applied to the load. When the dimmer is off, one touch restores the power to the load at the same level at which the dimmer was last touched.

While "touch" dimmers of the above type afford certain advantages, e.g., its bezel is relatively simple in construction and is readily separable from its supporting yoke to facilitate assembly and color changes, they suffer certain disadvantages as well. For example, touch-sensitive devices are very difficult to set with any precision at a desired level, and they will not operate if the user has rubber-soled shoes or a gloved hand. Moreover, they provide no visible indication of the level at which they will provide power when touched. Also, if the "touch" is too long, they immediately switch to an adjustment mode in which light level fades up or down, usually cycling through the maximum power level before turning off. Further, this device has no provision for being visible in the dark.

SUMMARY OF THE INVENTION

In view of the foregoing discussion, an object of this invention is to provide switch and dimmer device which affords the benefits of a bezel assembly, which is readily detachable to a yoke, but suffers none of the above-noted disadvantages of a touch-sensitive (i.e. capacitance-type) switch/dimmer device.

The switch and dimmer device of the invention features a self-contained bezel assembly which comprises a bezel housing and separate, manually-manipulatable switch and dimmer actuators. The bezel housing supports both actuators for respective movement between first and second positions, whereby the on/off state of an electrical switch adapted to apply power to an electrical load (e.g. an electric light or fan) is manually controllable, as is the level of power applied to the load by the switch. The bezel assembly is adapted to be releasably connected to a yoke member on which an electrical switch and dimmer circuitry are mounted, such switch and dimmer circuitry having movable actuating members which are positioned to be contacted and controlled by portions of the manually-manipulatable actuators of the bezel assembly when the bezel assembly is connected to the yoke member. Preferably, the switch actuator comprises a paddle-type actuator which is pivotally mounted between a pair of opposing side walls of the bezel housing, and the dimmer actuator comprises a slidably mounted member which is guided by a rectilinear slot formed in one of the bezel walls adjacent an edge of the paddle actuator.

According to a preferred embodiment, the switch and dimmer device of the invention also includes a night-light by which the switch actuator is framed in light so as to be readily seen in the dark.

The invention and its various advantages will be better understood from the ensuing detailed description of preferred embodiments, reference being made to the accompanying drawings in which like reference characters denote like parts.

BRIEF DESCRIPTION OF THE DRAWINGS

FIG. 2 is an exploded view of the wall switch of FIG. 1, showing the various elements of one embodiment of the invention and their relationship to other parts of the wall switch.

FIG. 7 is an elevational view of a leaf switch mechanism which can be used with the invention.

FIG. 8 is a sectional view illustrating the night light feature of the invention.

DETAILED DESCRIPTION OF PREFERRED EMBODIMENTS

Figure 1:
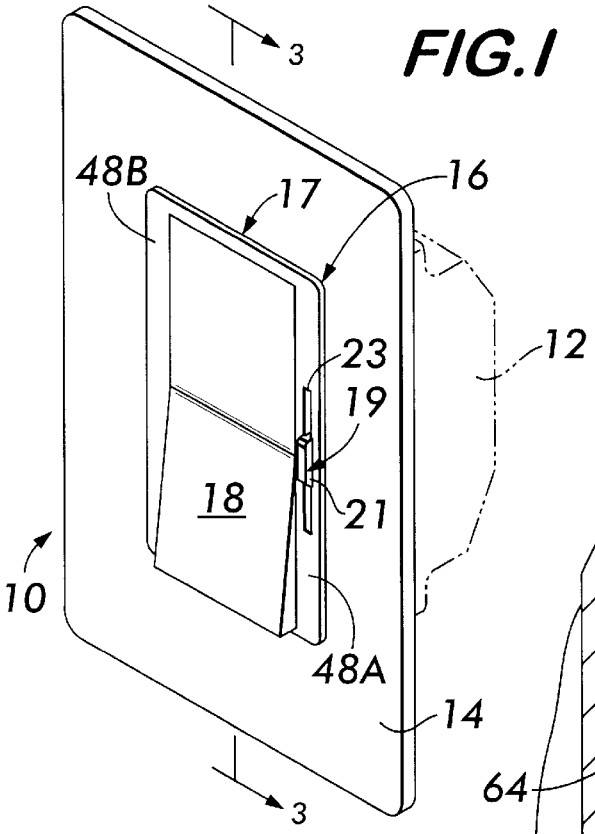
FIGS. 1 and 1A are perspective and front plan views of a wall switch embodying the present invention.
Figure 6:
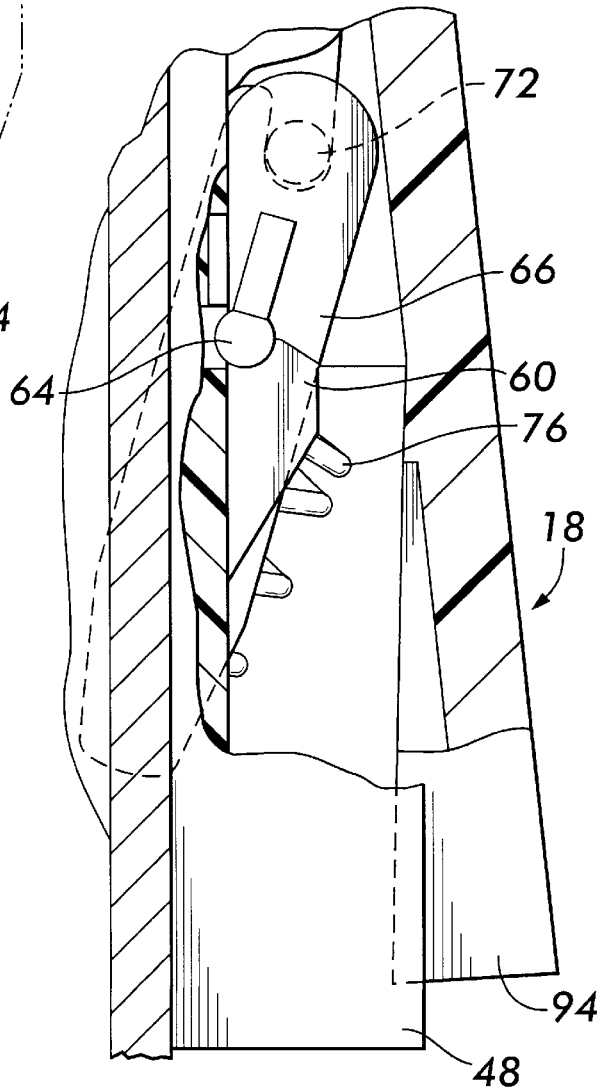
FIG. 6 is an enlarged simplified view taken along the line 6—6 in FIG. 5.
Figure 1A:
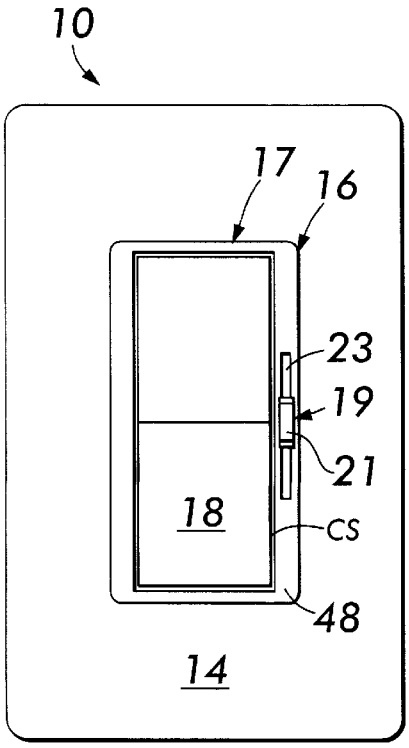

Referring now to the drawings, there is shown in FIGS. 1 and 1A an electrical switch and dimmer device 10 embodying the present invention. Device 10 comprises a backcover 12, and a bezel assembly 16 which includes a switch-actuating paddle 18. Bezel assembly 16 comprises a bezel housing 17 having a rectangular outer shape adapted to be received in a corresponding opening in faceplate 14. Backcover 12 and faceplate 14 may be conventional, but in any case the details of backcover 12 and faceplate 14 are not crucial to the present invention and need not be described further. A sidewall 48A of bezel housing is provided with a slot 13 for receiving and guiding a dimmer actuator 19, shown as a small tab 21, of a dimmer device D, shown in FIG. 2.

The various components of the switch and dimmer device of the present invention are best seen in the exploded view of FIG. 2. In FIG. 2, faceplate 14, and many of the details not necessary to understand and illustrate the invention, have been omitted for the sake of clarity. As seen in FIG. 2, bezel housing 17 is adapted to be snap-connected to a yoke 20, which is located behind faceplate 14 and which is essentially conventional. Yoke 20 may include threaded openings 22 by which a conventional faceplate 14 may be attached by screws in the usual manner. Alternatively, a snap-on faceplate 14, which mounts to yoke 20 without screws, may be used. Yoke 20 also includes openings 31 by which the entire switch and dimmer device may be rigidly connected to a conventional wall box (not shown). Yoke 20 supports a platform 24 on which may be mounted electrical and/or electronic circuitry, such as that normally associated with dimming device D or the like. In addition to such circuitry, platform 24 supports a microswitch 26 having a plunger 28 which is to be actuated by paddle 18, as will be described in greater detail below. Yoke 20 also has a rectilinear slot 27 formed therein. The manually-manipulatable dimming actuator 19 operates through slot 27 to engage a slidably mounted member 29 whose position determines the resistance of a variable resistor 25 comprising the dimming device. By this arrangement, sliding movement of the actuator 19 controls the position of member 29 and, hence, the power level applied to the load.

Bezel assembly 16 may be attached to yoke 22 in any convenient manner, e.g., by screws. Preferably, however, bezel housing 17 is molded as a single plastic piece and is provided with integral resilient tabs 30 which snap into corresponding openings 32 in yoke 20. Similarly, platform 24 is also preferably formed as a single plastic piece and is provided with integral resilient tabs 34 which snap into corresponding openings 36 in yoke 20. Platform 24 may further be provided with additional integral tabs 38 to support a printed circuit board 39. Backcover 12 may be attached to yoke 20 in any conventional manner.

Platform 24 is also preferably provided with locating pins 40 which are received in corresponding locating holes 42 in the housing of microswitch 26, thus enabling microswitch 26 to be attached to platform 24 as desired. Platform 24 also supports a small, low voltage lamp L (discussed below).

Plunger 28 of microswitch 26 projects through a corresponding opening 44 in yoke 20. Bezel housing 17 is also provided with an opening 46 in registry with opening 44 in yoke 20, in order to accommodate switches having plungers of different lengths and to enable plunger 28 to be actuated by paddle 18, as will be described in more detail below.

Bezel housing 17 has a peripheral wall 48 which extends around substantially the entire periphery of bezel 16. Wall 48 has a forward surface 50 which defines an imaginary plane. Projecting from oppositely-facing inner surfaces of opposing wall portions 48A and 48B are a pair of stub axles 52, which together define a pivot axis 54. Bezel housing 17 further includes a floor 56 in which is provided an opening 58 to accommodate components of the switching mechanism and night light L, to be described below. Floor 56 supports a pair of projections 60 on opposite sides of opening 58. Projections 60 together define a second pivot axis 62. Projections 60 are configured to receive therein stub axles 64 on a lever 66. Lever 66 has transverse dimensions less than the transverse dimension of opening 58 in bezel housing 17 so that lever 66 is pivotable about axis 62 with respect to bezel housing 17.

Figure 3:
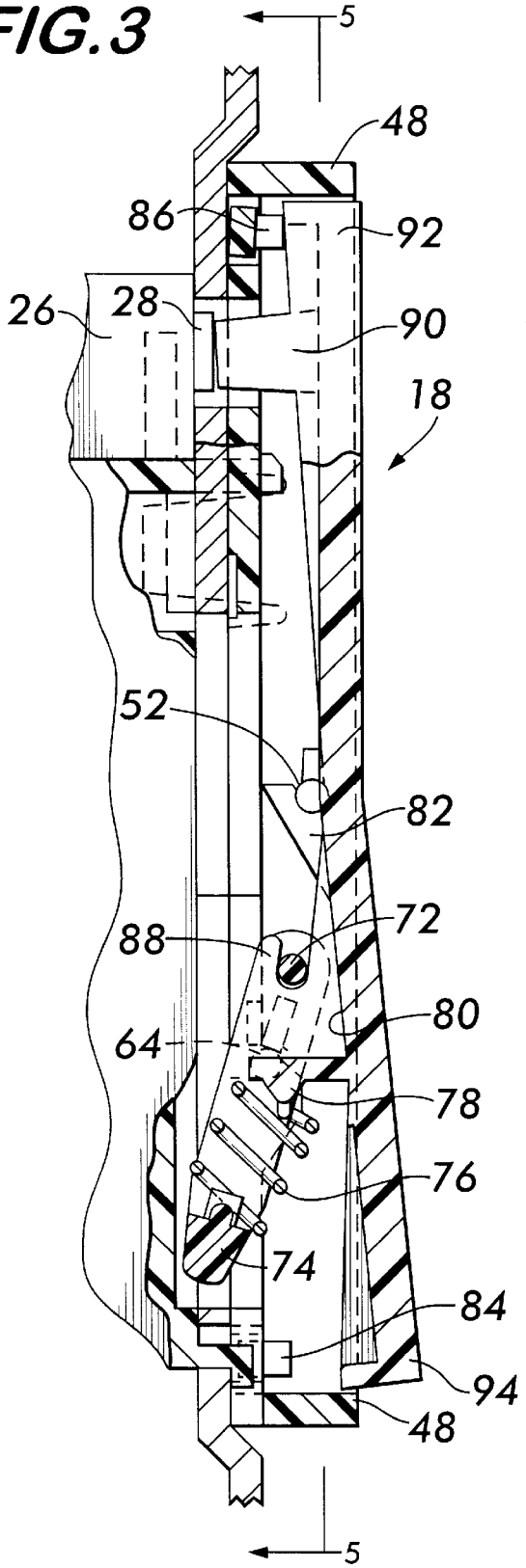
FIGS. 3 and 4 are simplified sectional views taken along the line 3—3 if FIG. 1, illustrating internal details and operation of the invention.
Figure 4:
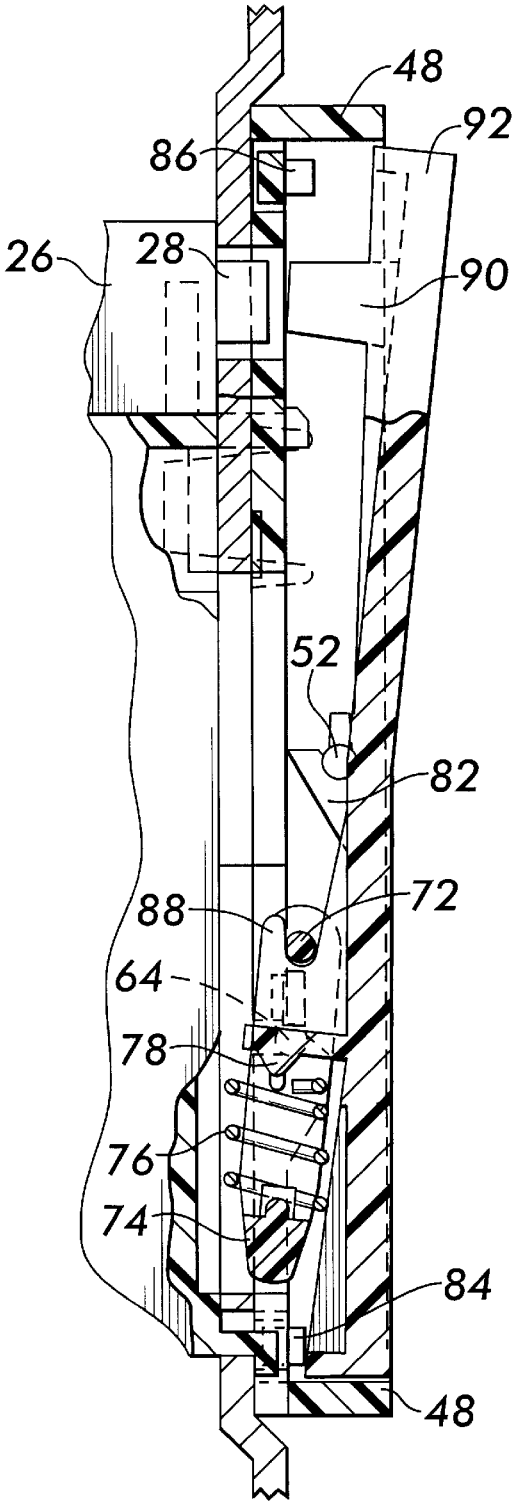

Preferably, lever 66 is in the form of a clevis, having parallel arms 68 and 70. A rod 72 extends between respective first ends of arms 68 and 70, and a spring receiver 74 is located between respective opposite ends of arms 68 and 70 for receiving and retaining one end of a spring 76. Spring 76 is preferably, but need not be, a coil spring. The opposite end of spring 76 engages a spring receiver 78 on the inner surface 80 of paddle 18. This is illustrated in FIGS. 3 and 4. Spring 76 is thus constrained between spring receiver 74 on lever 66 and spring receiver 78 on paddle 18.

Paddle 18 is pivotably mounted on stub axles 52 of bezel 16 for pivotable movement about axis 54. For this purpose, paddle 18 is provided on its inner surface 80 with a pair of depending arms 82 each having a semicircular recess for pivotably receiving stub axles 52 therein. Bezel 16 is provided with cantilever arm-mounted limit stops 84 and 86 to limit pivoting movement of paddle 18 to a range between first and second positions corresponding to first and second switch states. Cantilever arm-mounted limit stops 84 and 86 are displaceable for short distance with respect to floor 56 of bezel 16, and are displaceable for ease of insertion of paddle 18 into bezel 16 during assembly.

Figure 5:
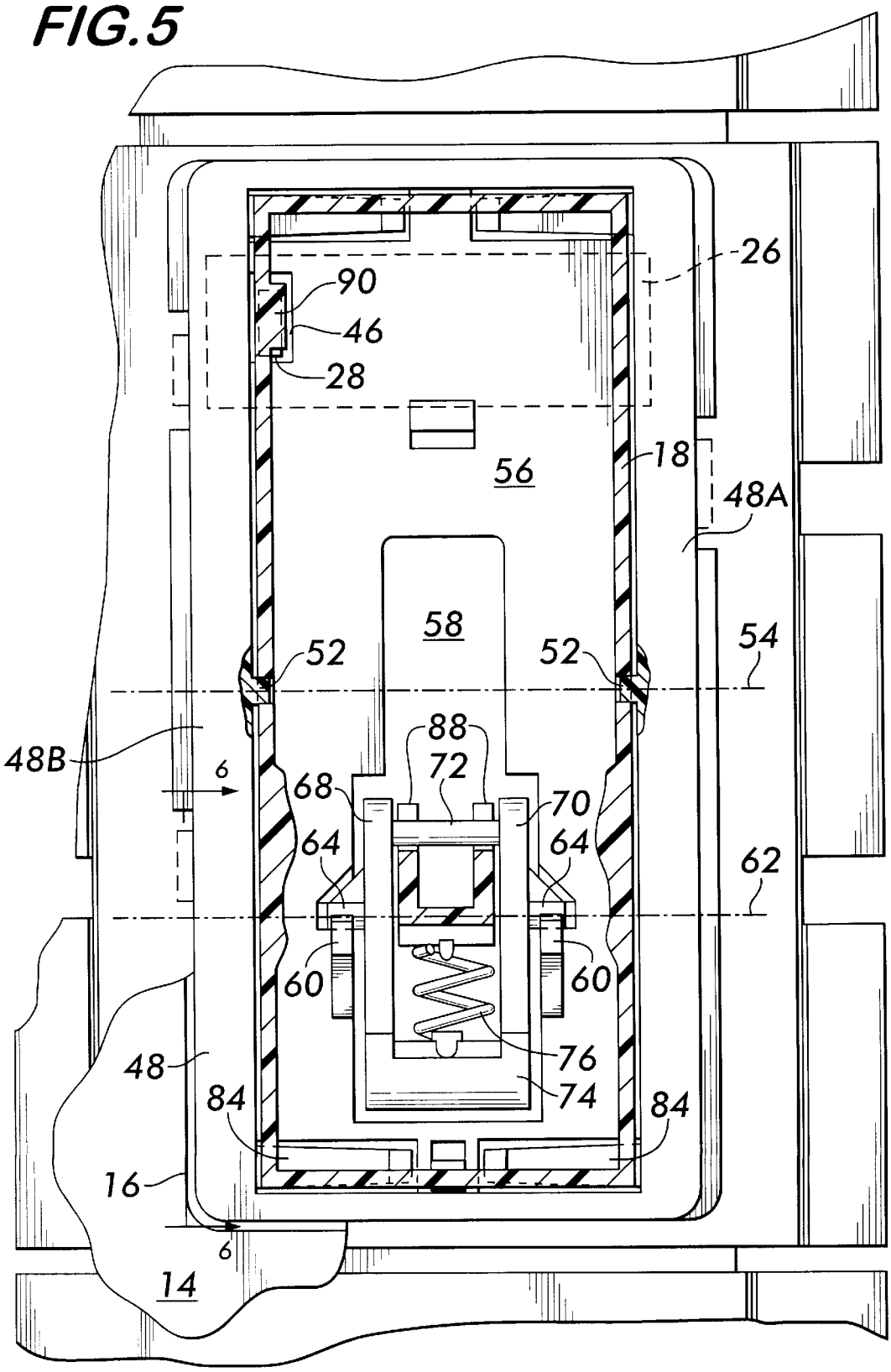
FIG. 5 is a simplified sectional view taken along the line 5—5 if FIG. 3.

Paddle 18 is also provided on its inner surface 80 with a pair of depending arms 88 each of which has an elongated recess therein for pivotably receiving rod 72 of lever 66, as can best be seen in FIG. 5. Pivoting movement of paddle 18 about axis 54 causes movement of depending arms 88, which transmit the movement of paddle 18 to rod 72 of lever 66, thus causing pivoting movement of lever 66 about axis 62.

As best illustrated in FIGS. 3 and 4, paddle 18 is further provided with a depending tab 90 in registry with opening 46 in bezel floor 56 and opening 44 in yoke 20, so that tab 90 makes contact with switch plunger 28 when microswitch 26 is to be actuated and breaks contact with switch plunger 28 when microswitch 26 is to be de-actuated.

Paddle 18 may be of any suitable shape as long as paddle 18 has two opposite ends 92 and 94 by which it can be actuated by a user. That is, ends 92 and 94 permit a user to manually apply pressure to paddle 18 to cause it to pivot about axis 54. The outer surface of paddle 18 may be substantially planar, or may be in the form of flat angularly-disposed planes which intersect at the center of paddle 18, as shown in the drawings. In addition, the dimensions of paddle 18 are not critical, and paddle 18 may be of any convenient dimensions.

As regards the "night-light" feature of the switch and dimmer device of the invention, low voltage is applied to lamp L through wires W in a conventional manner. Luminous energy from the lamp is directed through an opening 45 in yoke 20 and an opening 58 in bezel floor 56. Upon striking the inner surface 80 of paddle 18, this luminous energy is reflected toward the bezel floor 56. Referring to FIG. 8, after multiple reflections between the bezel floor and the inner surface of the paddle, the reflected luminous energy exits the bezel assembly through the clearance space CS between the outer edges of paddle 18, and the inside edges of bezel wall 48. To facilitate such multiple reflections, especially in the case where the paddle material is opaque or light-absorbing, it is preferred that the paddle and bezel floor surfaces which receive light from the lamp be provided with a diffuse, reflective material or tape. The diffuse surface operates to scatter the incident light, thereby providing a more uniform light level about the paddle periphery.

To connect paddle 18, lever 66 and spring 76 to bezel housing 17, paddle 18 is oriented with its inner surface 80 facing floor 56 of bezel housing 17. Rod 72 of lever 66 is inserted into the elongated recess on depending arms 88 on inner surface 80 of paddle 18. One end of spring 76 is placed on spring receiver 78 on paddle 18. Lever 66 is rotated toward spring 76 and the other end of spring 76 is placed on spring receiver 74 of lever 66. Rotation of lever 66 is continued until lever 66 rests against inner surface 80 of paddle 18. The end of spring 76 received in spring receiver 78 will seat in position as lever 66 is being rotated. This compresses spring 76 with sufficient force to retain lever 66 and spring 76 against inner surface 80 of paddle 18.

Paddle 18 is then inserted into bezel housing 17 so that the semicircular recesses in depending arms 82 engage stub axles 52 on bezel wall 48. During insertion, paddle 18 deflects the cantilever arm-mounted limit stops 86, allowing paddle 18 to rotate farther than during normal operation rotation. Then, paddle 18 is rotated back toward its normal operating position, causing stub axles 64 on lever 66 to snap into position under projections 60 on bezel housing 17. Paddle 18 is now in a first operating position. Rotating paddle 18 back again the opposite direction, toward its second operating position, pulls lever 66 away from paddle 18, freeing paddle 18 and lever 66 for normal operation. This completed assembly, and one of the two ends 92, 94 of paddle 18 extends past bezel wall 48. For purposes of illustrating the invention, end 92 extends past the bezel wall.

Operating of the assembled device will now be described. To actuate the wall switch 10, the outwardly protruding paddle end 92 is depressed by a user. Depression of end 92 causes paddle 18 to pivotably rotate about axis 54. This movement of paddle 18 causes lever 66 to also pivotably rotate, due to the action of arms 88 on rod 72 of lever 66. Lever 66 rotates about axis 62. As paddle 18 and lever 66 rotate about their respective axes, spring receiver 74 on lever 66 and spring receiver 78 on paddle 18 will move relative to one another. The relative motion of spring receivers 74 and 78 causes spring 76 to first compress, then extend, as paddle 18 is rotated. Compression of spring 76 at first causes paddle 18 to resist the rotation, and biases paddle 18 toward its initial position. However, as the user continues to depress paddle 18 and causes it to continue to rotate, spring 76 will extend as the midpoint of rotation is reached, and will snap paddle 18 into the opposite position without any further effort by the user. Spring 76 then biases paddle 18 into that position until paddle 18 is rotated back toward the initial position, when the sequence of events described above is repeated. To vary the level of electrical current applied by the switch to the load, dimmer actuator 19 is manually slided within slot 23 formed in bezel wall 48. Movement of the dimmer actuator controls the position of member 29 which, in turn, varies the resistance of the variable resistor 25.

It should be understood that many modifications to the various parts of the invention may be made without departing therefrom. For example, any style or type of wall plate may be used with the invention, and microswitch 26 is not the only type of switch that may be actuated by paddle 18. Moreover, microswitch 26 need not be directly actuated by tab 90 on paddle 18, but may be directly actuated by an intermediate mechanism or linkage. Also, while a paddle-type actuator is particularly preferred, a similarly shaped push-button-type actuator could be used. In this case, the bezel housing would support the actuator for movement perpendicular to the plane of bezel wall surface 50 and a spring would bias the actuator to an "out" position, in which tab 90 would not operate to depress the switch plunger 28.

An alternate type of switch which may be actuated by paddle 18 is illustrated in FIG. 7. This is a simple, low cost leaf switch 100 having a fixed contact 112 and a movable contact 114. Wire 104 is connected directly to contact 112. Wire 102 is connected to contact 114 via rivet 110 and leaf spring 106. Leaf spring 106 biases contact 114 into connection with contact 112, thus completing the circuit between wires 102 and 104, when no external force is applied to leaf spring 106.

However, an external force can be applied to bend 108 in leaf spring 106, by tab 90 of paddle 18, forcing contact 114 away from contact 112 and breaking the circuit between wires 102 and 104.

Contacts 112, 114, leaf spring 106 and rivet 110 are made of electrically conductive material. Support means 116 for leaf spring 106 and 118 for fixed contact 112 are made of electrically insulating material and are preferably an integral part of platform 24.

Spring 76 need not be a coil spring, but may be a leaf spring or any other suitable spring, or it could be an integral part of lever 66. Many other modifications may also suggest themselves to those skilled in the art, and it should be understood that the preferred embodiment of the invention described herein is illustrative only and does not limit the invention to the precise structure shown.

The actuator-supporting bezel housing 16 described is entirely self-contained, and has a very shallow profile which does not intrude into the interior of the wall box. In addition, the bezel housing may be assembled remotely from the remainder of the wall switch and attached to it at any later time, either in the factory or in the field. This allows a great degree of flexibility in choosing colors or finishes, which is an important consideration in many cases where the apparatus of the invention will be used. Also it is readily adapted to receive a dimmer actuator for controlling the level of current applied to a load.

What is claimed is:

1. A switch and dimmer device for controlling electrical power applied to a load, said device comprising:

(a) a yoke having at least one mounting opening therein for connecting the yoke to an electrical wall box;

(b) an electrical switch adapted to selectively apply power to the load from a power source, said electrical switch being supported by said yoke and having a switch actuator which is selectively operable to control the on/off state of said electrical switch;

(c) a dimmer adapted to control the level of power applied to the load, said dimmer being supported by said yoke and having a dimmer actuator which is selectively operable to control the level of power applied to the load by the switch;

(d) a backcover secured to said yoke, the backcover and yoke cooperating to form an enclosure to house said electrical switch and said dimmer; and (e) a bezel assembly comprising:

(i) a bezel housing;

(ii) a first manually-manipulatable member movably mounted directly on and retained by said bezel housing and operatively coupled to said switch actuator when said bezel assembly is connected to said yoke, for selectively controlling the operation of said switch actuator; and (iii) a second manually-manipulatable member movably mounted directly on and retained by said bezel housing and operatively coupled to said dimmer actuator when said bezel assembly is connected to said yoke, for selectively controlling the operation of said dimmer actuator, said bezel assembly being removable with respect to said yoke while said yoke remains secured to said backcover.

2. The apparatus as defined by claim 1 wherein said first manually-manipulatable member comprises a paddle pivotally mounted on said bezel housing and having a tab member which engages said switch actuator during pivotal movement of said manually-manipulatable member to actuate said electric switch.

3. The apparatus as defined by claim 1 wherein said second manually-manipulatable member is slidably mounted on said bezel housing.

4. The apparatus as defined by claim 1 wherein said dimmer device comprises a variable resistance device, and wherein said dimmer actuator comprises a slidable member, the position thereof controlling the resistance of said variable resistance device.

5. The apparatus as defined by claim 4 wherein said second manually manipulatable member is slidably mounted on said bezel housing and includes means for engaging said slidable member for controlling the position thereof.

6. The apparatus as defined by claim 1 wherein said bezel member comprises a wall which surrounds the perimeter of said first manually-manipulatable member.

7. The apparatus as defined by claim 6 wherein said wall defines a slot in which said second manually-manipulatable member is movable.

8. The apparatus as defined by claim 6 wherein said yoke supports an electric lamp for illuminating a clearance space between said wall and first manually-manipulatable member, whereby the location of the latter is visible in the dark.

9. The apparatus as defined by claim 8 wherein a surface of said first manually-manipulatable member and a surface of said bezel housing are adapted to diffusely reflect radiation energy emitted by said electric lamp to enhance the illumination of said clearance space.

10. In an apparatus for controlling the current applied to an electric lamp to control the on/off state and intensity of the lamp, said apparatus comprising:

(a) a yoke having at least one mounting opening therein for connecting the yoke to an electrical wall box;

(b) an electrical switch adapted to selectively apply current to the lamp from a power source, said switch being supported by said yoke and having a movable actuator for controlling the on/off state of said electrical switch;

(c) a dimmer mechanism adapted to control the intensity of the lamp, said dimmer mechanism being supported by said yoke and having a movable dimmer actuator for controlling the level of current applied to the lamp by the switch based on the position of said movable dimmer actuator; the improvement comprising;

(d) a backcover secured to said yoke, the backcover and yoke cooperating to form an enclosure to house said electrical switch and said dimmer, and (d) a bezel assembly comprising a bezel housing which directly movably supports and surrounds a first movable member for controlling the operation of said switch actuator when said bezel assembly is connected to said yoke, said bezel housing further directly movably supporting a second movable member for selectively controlling the position of said movable dimmer actuator when said bezel assembly is connected to said yoke, the first and second movably members being retained by the bezel housing, said bezel assemblys being removable from said yoke while said yoke remains secured to said back cover.

11. The apparatus as defined by claim 10 wherein said first movable member comprises a paddle pivotally mounted on said bezel housing.

12. The apparatus as defined by claim 10 wherein said second movable member is slidably mounted on said bezel housing.

13. The apparatus as defined by claim 10 wherein said first movable member comprises a paddle member pivotally mounted between opposing walls of said bezel housing.

14. The apparatus as defined by claim 10 wherein said electrical switch is a microswitch.

15. The apparatus as defined by claim 10 wherein said electrical switch comprises a leaf switch having a fixed contact, a movable contact, and a leaf spring for biasing the movable contact relative to the fixed contact, said movable actuator being operatively connected to the movable contact to control the position thereof.

16. The apparatus as defined by claim 10 wherein said bezel housing comprises a wall which surrounds the perimeter of said first movable member.

17. The apparatus as defined by claim 16 wherein said second movable member comprises a tab member slidably mounted in a slot defined by said wall of said bezel housing.

* * * * *

UNITED STATES PATENT AND TRADEMARK OFFICE

CERTIFICATE OF CORRECTION

PATENT NO. : 6,005,308
DATED : December 21, 1999
INVENTOR(S) : Bryde et al.

It is certified that error appears in the above-identified patent and that said Letters Patent is hereby corrected as shown below:

Title page,
Item [63], Related U.S. Application Data, change "Mar. 31, 1993" to -- Mar. 31, 1992 --.

Signed and Sealed this

Twelfth Day of October, 2004

JON W. DUDAS
*Director of the United States Patent and Trademark Office*